United States Patent [19]

Dahl

[11] Patent Number: 4,754,632

[45] Date of Patent: Jul. 5, 1988

[54] APPARATUS FOR BENDING STRUCTURAL METAL RAILS

[75] Inventor: Tor Dahl, Rjukan, Norway

[73] Assignee: Rjukan Metall A/S, Rjukan, Norway

[21] Appl. No.: 32,286

[22] Filed: Mar. 30, 1987

[30] Foreign Application Priority Data

Apr. 7, 1986 [NO] Norway ..... 861347

[51] Int. Cl.[4] ..... B21D 7/04

[52] U.S. Cl. ..... 72/149

[58] Field of Search ..... 72/133, 134, 149, 150, 72/154, 155, 156, 159, 295

[56] References Cited

U.S. PATENT DOCUMENTS

| | | | |
|---|---|---|---|
| 1,267,845 | 5/1918 | Burt | 72/133 |
| 1,520,635 | 12/1924 | Evans | 72/156 |
| 2,346,468 | 4/1944 | Brickman et al. | 72/156 X |
| 4,261,145 | 4/1981 | Brocking | 72/149 X |
| 4,350,033 | 9/1982 | Ishihara | 72/149 X |

FOREIGN PATENT DOCUMENTS

| | | | |
|---|---|---|---|
| 314226 | 9/1919 | Fed. Rep. of Germany | 72/149 |
| 198103 | 6/1967 | U.S.S.R. | 72/295 |

*Primary Examiner*—E. Michael Combs

*Attorney, Agent, or Firm*—William C. Norvell, Jr.

[57] ABSTRACT

The invention relates to an apparatus for bending structural metal rails, preferably rails for multi-glazed windows, and gives instructions for a bending unit (20) having two wringing heads (6) which can be displaced relative to the width of the rail, for in an open position to allow the infeed of rails (5) having various width, and in an attracted position to clamp a portion of the rail (5) for the bending thereof by turning the wringing heads (6). Since each wringing head (6) is provided with a protrusion (6*a*) having an edge (6*b*) serving to position the rail (5) upon the closing of the wringing head (6) and to support the rail (5) during the bending operation, there is also defined a space (6*c*) between the protrusions (6*a*), said space (6*c*) defining an infeed path for further supply of rail (5) immediately after a bending operation and after the opening of the wringing heads (6), so that the infeed of a further length of rail takes place synchronously with the return movement of the wringing heads (6) to the starting position for another bending operation.

13 Claims, 4 Drawing Sheets

L1 = L2
L3 − L2 = h
22
22a
22a
L1
L2
L3
5a
5
h 23a
28
22
21
24
20
25
26
27 h=const.
B1
B2
B3
α≈const.

1b
1c
1d
1
20
1a
4
3a
6
6b
5
7
6a
11
3b
8
6c
6
9

APPARATUS FOR BENDING STRUCTURAL METAL RAILS

FIELD OF THE INVENTION

The present invention relates to an apparatus for bending structural metal rails, preferably structural rails for multi-glazed windows, which are used in the production of insulated windows.

STATE OF THE ART

According to prior art, the parts which are to be included in the finished metal frames will be cut in separate lengths for thereafter to be joined at the corners by means of special, separate corner pieces.

This involves a relatively complicated and work-consuming process, the known method being very unfavourable as regards automated production of metal frames.

From SE patent publication No. 439 514 (7810342-1) there are known distance pieces for multi-glazed windows having several window panes, comprising a hollow structural rail which is made to a frame. The frame is manufactured by bending, there being used a bending device comprising a roller and a turnable bending element. The length of the rail which is to be bent is determined by a stopper which can be displaced relative to the bending device.

However, the prior art gives no instructions as regards a rational and effective technique for bending of metal rails for procuring bent blanks which only have to be put together by means of only one corner piece, the apparatus at the same time being able to handle structural rails having various dimensions.

Neither does the prior art give instructions for a bending apparatus rendering finished metal frames having corners which do not include uneven surfaces, independent of the various widths of the metal rails.

On the market for structural metal rails which are used for the manufacturing of multi-glazed windows, there exist today 10–15 various sizes. When known apparatuses are adjusted from one size of rails to another, it is necessary to exchange the main tool of the apparatus, a fact which involves that the manufacturing of frames having various metal rails is cumbersome and time consuming.

Neither can it be found in the prior art how an accurate length measurement of the rail can be carried out, which is of outmost importance due to the consumption of material in the bending zones.

OBJECTS OF THE INVENTION

The object of the present invention is to provide a bending apparatus which allows bending of a structural rail in three or more sequential bending operations, whereafter the bent rail can be put together to a frame by means of only one corner piece or one joining piece.

Another object of the present invention is to provide a bending apparatus which can bend structural rails of various dimensions without exchanging the main tool, i.e. the bending unit itself is to be provided with means allowing for an automatic adjustment of the bending means relative to the various dimensions in question.

A further object of the present invention is to provide a bending apparatus which measures very accurately the length of the structural rails which are to be bent, whether the dimensions are measured from a transversly cut edge or from a bent corner.

SUMMARY OF THE INVENTION

The above stated objects are achieved in an apparatus of the type stated in the preamble, which according to the invention is characterized in that the apparatus comprises a bending unit having two wringing heads which can be displaced relative to the rails, for in a retracted position to allow for the infeed of rails having various width dimensions, and in an attracted position to clamp a portion of the rail for the bending thereof by turning the wringing heads.

Preferably, there may between the wringing heads be provided a center pin under which the structural rail is inserted prior to the bending operation, each of the wringing heads carrying a protrusion with an edge serving for the positioning of the rail upon attraction of the wringing heads, and for the support of the rail during bending operation.

By means of the two wringing heads which can be displaced, preferably sidewise relative to each other, for in an open position to allow the infeed of structural rails having various widths, and in an attracted position to clamp a portion of the rail for the bending thereof, the wringing heads at the same time being turnable about a common axis for the performance of the bending operation of the rail clamped therebetween, there is provided a bending apparatus which does not have to exchange the main tool if rails having various sizes are to be bent to frames.

Since between the protrusions on each wringing head there is left a space, even during the bending or twisting operation, this space will serve as an infeed path for further lengths of the rail immediately after a bending operation, i.e. immediately after the retraction of the wringing heads after a completed bending operation and a release of the bent rail portion, and prior to the return of the wringing heads to the starting position for bending operation. Thereby is achieved a quick and effective infeed of further profiled lengths, i.e. the new length which is to be bent, is brought forward and is ready for having the wringing heads clamped against itself so to say immediately upon the return of the wringing heads to the starting position for a new wringing operation.

Preferably the displacement of the wringing heads is carried out in the transverse direction of the rail by means of a power cylinder rendering a predetermined closing pressure against the rail, independent of the width thereof.

The wringing of the wringing heads themselves can take place by means of a power turning means, preferably taking the shape of a turning arm which is driven by a stroke cylinder, and which cooperates with stopper means and signal transducers for the control of the bending movement and the return movement.

The present apparatus can also comprise an adjustable stopper serving for the measurement of the structural rail which is to be bent, and which cooperates with an end stopper allowing for further displacement of the stopper so as to avoid that the stopper will lock the rail during the bending operation.

Appropriately, the stopper comprises a stopping portion which in connection with a transversely cut rail stops the rail at the cut edge thereof, and which in connection with a bent rail stops the rail at the outer portion of the rail, a fact with renders a measuring difference corresponding to the height of the rail.

The apparatus also comprises an infeed device for the rail, which cooperates with stopper means and transducers, and in the housing of the bending unit there is appropriately provided a supporting means for the rail, which supporting means cooperates with the wringing heads and the center pin for avoiding a deflection of the rail in the area of the wringing heads, and thereby aiding in giving the rail a correct bending point.

BRIEF DISCLOSURE OF THE DRAWINGS

Further features and advantages of the present apparatus will appear from the following description, reference being had to the attached drawing.

FIG. 1 is a front view of a working table including an apparatus for bending structural rails.

FIG. 1*a* is a sketch illustrating the principle of a stopper means which may be included in the present apparatus.

Figures 4, 4A:
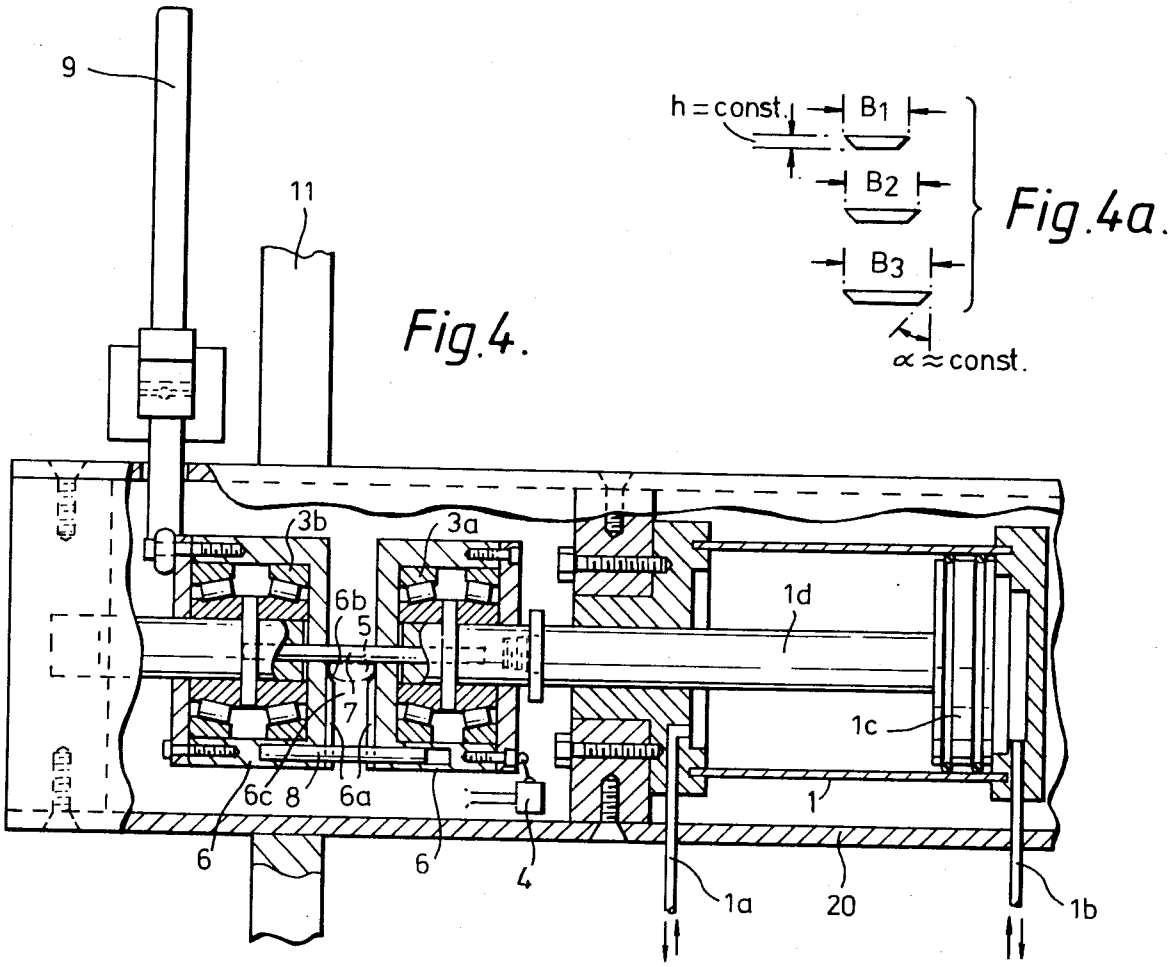
FIG. 4 is a side view of the bending unit of FIG. 3, shown partly in section.

FIG. 4*a* illustrates examples of various rail widths which can be used in the present apparatus.

DISCLOSURE OF EMBODIMENTS

As appearing from the drawings which illustrate an embodiment of an apparatus for bending structural metal rails, in which the present invention is included, the apparatus comprises a bending unit 20. This bending unit 20 comprises a first stroke cylinder 1 (FIG. 4) which via conduits 1*a* and 1*b* is influenced by a fluid, such that the piston 1*c* with its piston rod 1*d* can move in different directions relative to the center axis C—C of the bending unit 20. At the end of the piston rod 1*d* which is opposite to the piston 1*c*, there is provided a bevel roller bearing 3*a*, which by its reciprocating movement influences an electrical signal transducer 4, and which constitutes the main member of a first wringing head 6 having a protrusion 6*a*. In the bending unit 20 there is also provided a second bevel roller bearing 3*b* which is fixed relative to the center line C—C of the bending unit 20, but which constitutes a second wringing head 6 having a protrusion 6*a* provided just opposite of the protrusion 6*a* of the wringing head 6 on the piston rod 1*d*.

Since one of the wringing heads 6, here the one which is provided on the piston rod 1*d*, can be displaced, there will between the wringing heads 6 be defined an opening 6*c* for the infeed of a structural rail 5, the rail 5 being passed under a center pin 7 which is provided at the center portions of the wringing heads 6.

Thus, at the start of a bending operation a rail 5 will be fed into the space 6*c* between the wringing heads 6 and beneath the center pin 7, the protrusions 6*a* with their upper inclined edges 6*b* serving to position the rail 5 when the wringing heads 6 are approaching each other. After an appropriate feeding of the rail, the two wringing heads 6 will be displaced closer to each other and clamp against the sides of the rail, and the said protrusions 6*a* with their edges 6*b* will then support the rail 5 during the succeeding bending operation.

In the area of the protrusions 6*a*, i.e. in the space 6*c* defined between the protrusions 6*a*, there is also provided a stabilizing pin 8 serving for further stabilization of the wringing heads 6 together with the above discussed center pin 7.

In connection with the bending unit 20 there is also provided a supporting means 13 (FIG. 3) cooperating with the wringing heads 6 and the center pin 7 for thereby avoiding deflection of the rail 5 in the area of the space 6*c* between the wringing heads 6, and thereby rendering the rail 5 a correct bending point.

It is to be understood that the relative displacement of the wringing heads 6, i.e. displacement of one or the other wringing head, takes place by means of the pressure cylinder 1, which provides a predetermined closing pressure against the rail 5 independent of the width thereof. Examples of various rails having different widths are illustrated in FIG. 4*a*.

It is to be understood that the angle defined by the inclined edges 6*b* on the protrusions 6*a*, is to correspond to the inclined edges of the rail 5, here designated by the angle $\alpha$ at the bottom of FIG. 4*a*. However, it is to be understood that this angle will change very little with the width of the various profiles, and can for all practicle purposes be considered as approximately constant for current rails.

Figures 1, 1A:
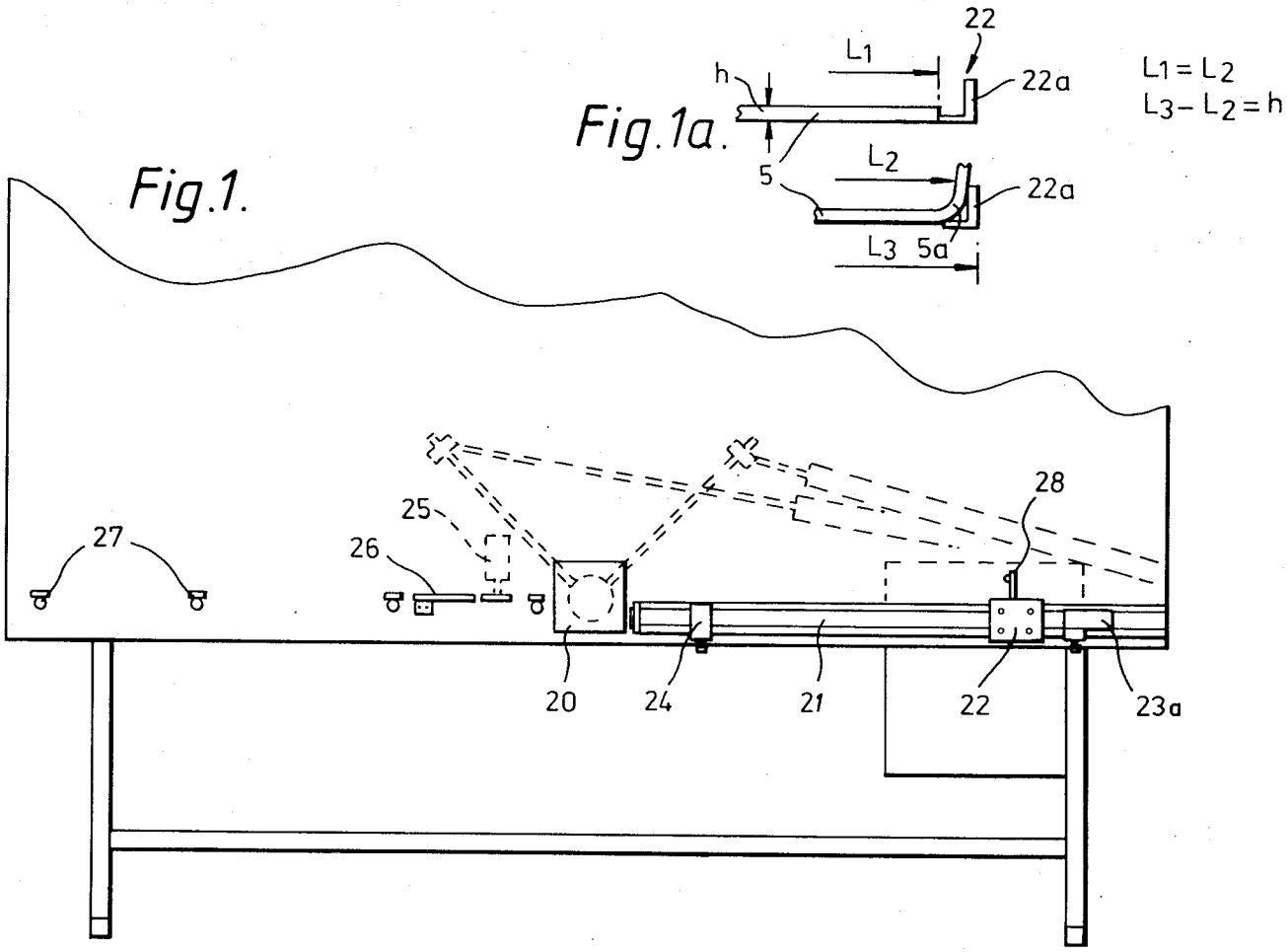
Figure 3:
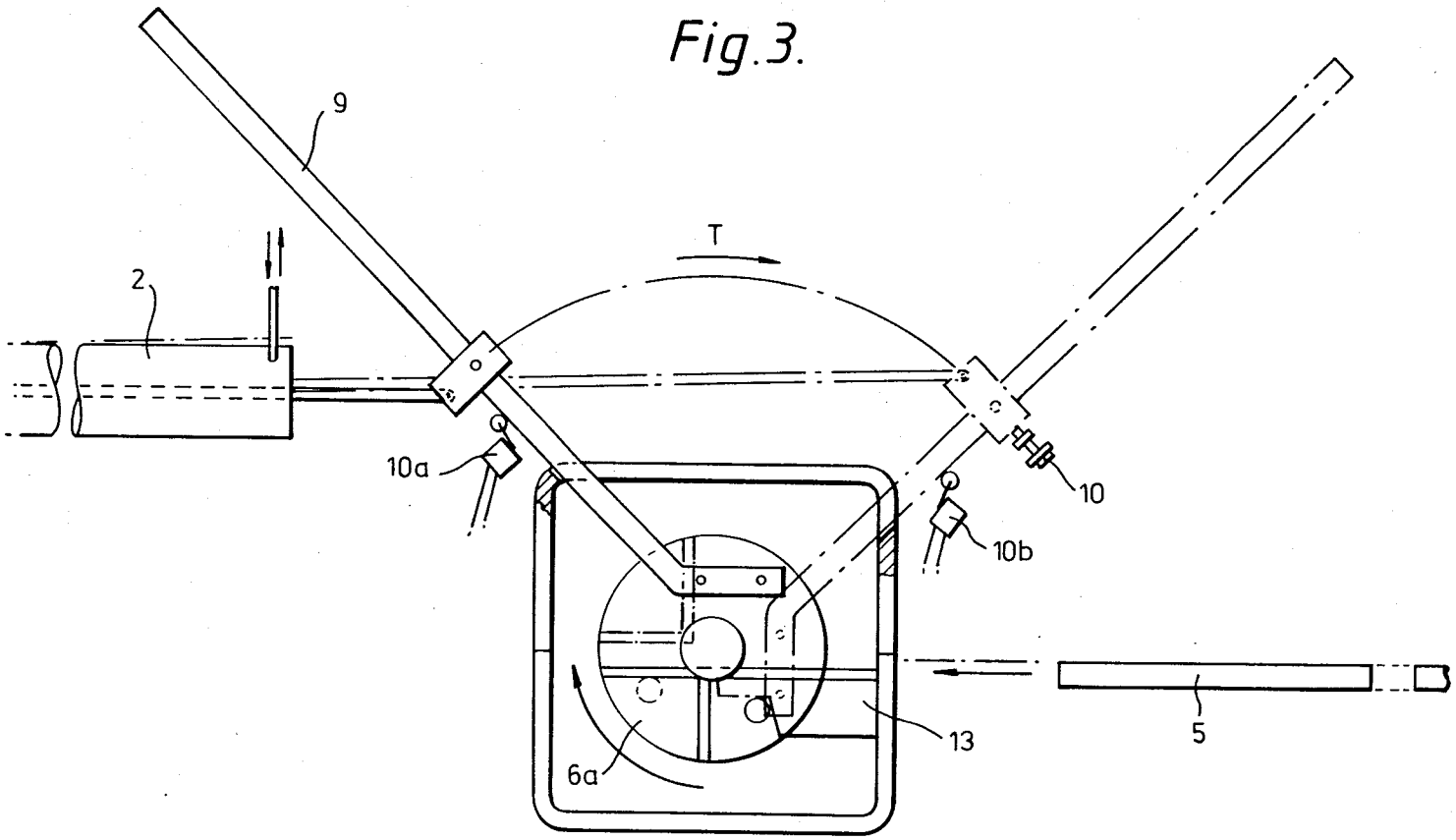
FIG. 3 is on a larger scale an end view of an embodiment of a bending unit.

When the rail 5 has taken its correct position in the space 6*c* between the wringing head 6 and is clamped therebetween, the wringing heads 6 will be subjected to a turning movement by means of a power turning means in the form of a bending arm 9 which is driven by a second stroke cylinder 2, and which cooperates with stopper means 10 and signal transducers 10*a* and 10*b* for the control of the bending movement in the direction of the arrow T in FIGS. 1 and 3, and for the control in opposite direction of the return movement following the accomplished bending operation.

Due to the space 6*c* between the protrusions 6*a* and the wringing heads 6, the wringing heads 6 will immediately after the accomplished bending operation, and immediately after having been retracted from each other for thereby no longer effecting a pressure on the side edges of the rail, allow for the infeed of another length of the rail, at the same time as the wringing heads 6 are returned to the initial position for a new wringing operation, i.e. in the opposite direction of the arrow T.

Thus, a new length of the rail will be ready for being clamped by the wringing heads 6 with their protrusions 6*a*, when the same take their return position after a previous wringing operation.

It is to be understood that the above discussed power turning means taking the form of a turning arm 9, will turn the wringing heads 6 to a predetermined angle, in the present case preferably 90 degrees, and that this angle can be adjusted according to prevailing conditions.

Figure 2:
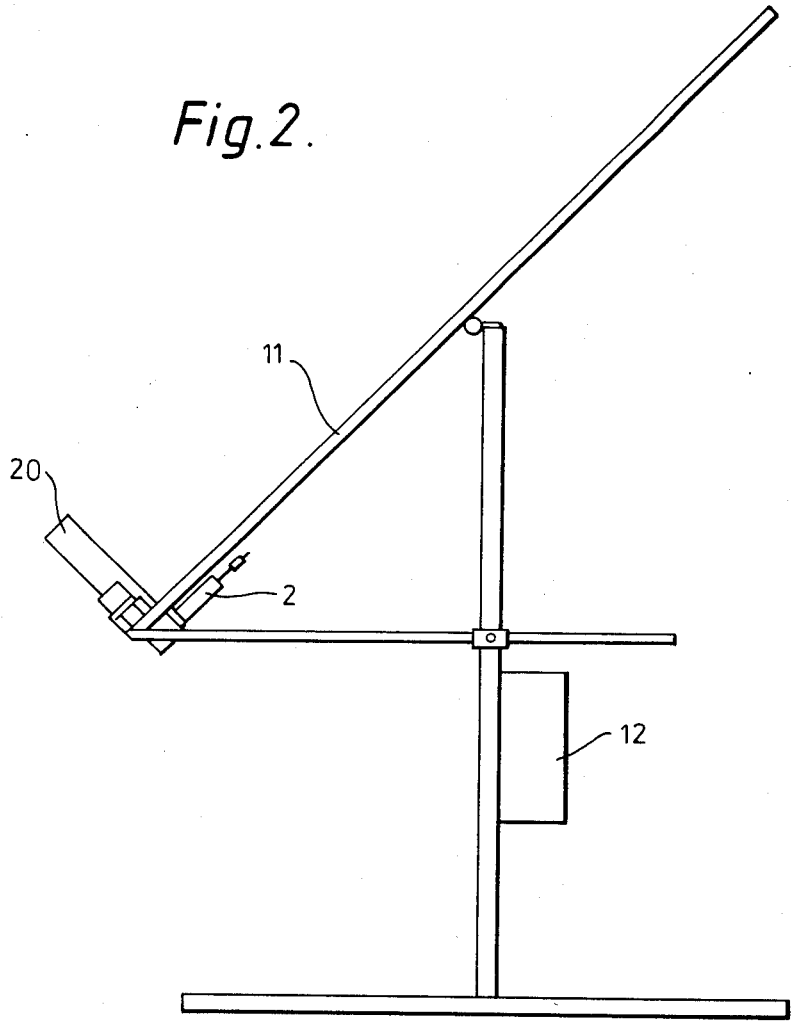
FIG. 2 is a side view of the apparatus illustrated in FIG. 1.

As most clearly appearing from FIGS. 1 and 2, the bending unit 20 with associated equipment is mounted on a working table 11 comprising a main plate which can be adjusted to various angular positions. At the rear side of the working table 11 there is provided a control cabinet 12 housing control instruments for both the electro mechanical and hydraulic functions.

In connection with the bending unit 20 which is mounted on the working table 11, there is provided a cylinder 21 having an external glider, as well as an adjustable stopper 22 serving for the measurement of the rail portion which is to be bent, and which cooperates with an end stopper 23 serving for a further displacement of the stopper 22 for avoiding the hookup of the rail 5 to the stopper 22 during the bending operation. The end stopper 23 comprises a cylinder 23*a* rendering the further displacement possible.

As appearing from FIG. 1*a* the above discussed stopper 22 comprises a stopper portion 22*a* which during the infeed of a straightly cut rail 5, as this is illustrated at the top of FIG. 1*a*, stops the rail 5 at said transveresly cut edge, and this stopping of the rail 5 corresponds to a distance L1 to which the stopper 22 has been adjusted.

After an accomplished bending the L-shaped stopper portion 22*a* of the stopper 22, allows the bent rail portion 5*a* to be entered onto itself, so that the rail with its outer portion of the bent corner slides over the narrow foot portion of the stopper portion 22*a* and stops against the leg portion of the stopper portion 22*a* after a certain length L2, as this appears from the bottom sketch of FIG. 1*a*.

After a bending operation the rail 5 will, accordingly, with its bent outer portion stop against a larger upwardly extending portion of the stopper portion 22*a*, a fact which entailes a measuring difference $L3-L2=h$, corresponding to the height of the rail.

It is to be understood that the apparatus comprises a further mechanically adjustable end stopper 24 cooperating with the cylinder 21 with the outer glider.

Further, the apparatus comprises an infeed device which in turn comprises an air motor 25 for the infeed of the list or the rail 5, as well as a tightening device 26 rendering a stable and even gripping of the rail 5 during the infeed motion. One or more ball bearings 27 are provided on the working table 11 for the support of the rail 5 during the infeed thereof.

Further, the apparatus comprises an electric signal transducer 28 which appropriately cooperates with other above discussed stopper means and transducers.

In FIG. 4*a* there are illustrated various examples of rails having different widths, but which have substantially the same height. There are illustrated three various widths B1, B2 and B3, respectively, the height h being approximately constant. However, all of these rail widths can be fed into the space 6*c* between the wringing heads 6, the center pin 7 and the inclined surfaces 6*b* of the protrusions 6*a*. This involves that even if the apparatus is to handle another rail width, it is not necessary to exchange the wringing heads 6 themselves, since the adjustment thereof to an appropriate maximum opening which allows for the receipt of the novel width is carried out automatically, whether this width is larger or smaller than the prevous one.

It is to be understood that the apparatus according to the invention can be implemented in other ways than the one which is discussed above. For example, the above discussed mechanical stoppers which are adjusted for certain rail lengths to be bent, can be replaced by electronic units, for example an electronic measuring wheel which can be programmed for monitoring the infeed of correct rail lengths.

I claim:

1. Apparatus for bending structural metal rails to form a unitary bent closed frame structure suitable for framing windows when closed by a single corner piece, comprising:

a bending unit (20) having first and second clamping heads (6) which can be displaced relative to the rail to be bent from a first mutually distant position to allow infeed of rails having various width dimensions, to a second mutually close position to clamp a portion of the rail during the bending thereof;

turning means for rotating the first and second clamping heads from an initial position to a bent rail position, thereby bending the rail (5);

each of said clamping heads having a protrusion (6*a*), said protrusions extending toward each other for supporting the rail (5) during the bending operaiton, each of said protrusions having an edge (6*b*) serving to position the rail (5) when said clamping heads (6) are displaced from the first distant position to the second close position;

said clamping heads (6) when in the second close position having their protrusions spaced from each other and defining an infeed path space (6*c*) for receiving another section of the rail (5) immediately after a bending operation when the clamping heads have commenced travel from the second close position towards first distant position and before return rotation thereof to the initial position for another bending operation.

2. Apparatus as defined in claim 1, further comprising:

a center pin (7) between the clamping heads (6) and under which the rail (5) is passed prior to the bending operation.

3. Apparatus as defined in claim 1, further comprising:

a pressure cylinder (1) for displacing the clamping heads (6) traversely with respect to a longitudinal direction of the rail (5) and providing a predetermined closing pressure against the rail (5) independent of the width of the rail.

4. Apparatus as defined in claim 3, wherein the turning means is a powered turning means for rotating the clamping heads (6) a predetermined angle.

5. Apparatus as defined in claim 4, wherein the power turning means comprises:

a stroke cylinder (2);

stopper means (10); and a turning arm (9) driven by the stroke cylinder (2) and cooperating with the stopper means (10) for controlling the bending movement and the return movement of the clamping heads (6).

6. Apparatus as defined in claim 1, further comprising:

an end stopper (23); and an adjustable stopper (22) movably displaceable with respect to end stopper (23) to allow for a further displacement of the stopper (22) with respect to the end stopper (23) to avoid jamming of that portion of the rail (5) which is bent during the bending operation.

7. Apparatus as claimed in claim 6, wherein the end stopper (23) comprises a cylinder (23*a*) for movably displacing the end stopper (23) to achieve the further displacement.

8. Apparatus as claimed in claim 7, wherein the stopper (22) has a stopper portion for engaging the rail (5) at the straightly cut edge thereof, and for engaging the rail (5) against bent outer portion of the rail after the rail has been bent, such as to provide measuring difference corresponding to the height of the rail.

9. Apparatus as defined in claim 1, further comprising:

powered infeed means (25) for feeding the rail (5) between the clamping heads.

10. Apparatus as defined in claim 2, further comprising:

supporting means (13) for engaging a lower face of the rail in a bending region of the rail adjacent the clamping heads (6) and the center pin (7) to avoid deflection in the bending portion of the rail.

11. A method of bending structural metal rails to form a unitary bent closed frame structure suitable for framing windows when closed by a single corner piece, comprising:

providing first and second clamping heads (6) each having a protrusion (6*a*), said protrusions extending toward each other for supporting the rail (5) during a subsequent bending operation, and having an edge (6*b*) for positioning the rail (5) when said clamping heads (6) are subsequently displaced from a first distant position to a second close position;

positioning the first and second clamping heads in the first mutually distant position for feeding therebetween rails having various width dimensions;

displacing the first and second clamping heads (6) relative to the rail to be bent from the first mutually distant position to the second mutually close position with said protrusions spaced from each other to clamp a portion of the rail during the bending thereof;

rotating the first and second clamping heads from an initial position to a bent rail position, thereby bending the rail (5);

thereafter feeding another section of the rail (5) between the clamping heads (6) in the space defined between the protrusions immediately after the bending operation as the clamping heads commence travel from the second close position towards the first distant position and as the clamping heads rotate from the bent rail position to their initial position; and thereafter rotating the clamping heads fully to their initial position for another bending operation.

12. A method as defined in claim 11, further comprising:

infeeding the rail (5) between the clamping heads and beneath a center pin (7) between the clamping heads (6).

13. The method as defined in claim 11, further comprising:

providing a support (13) adjacent the clamping heads (6) for supporting the rail during the bending operation to avoid deflection of the rail.

* * * * *